US011620945B2

(12) United States Patent
Zhang et al.

(10) Patent No.: US 11,620,945 B2
(45) Date of Patent: Apr. 4, 2023

(54) DISPLAY PANEL, DRIVING METHOD AND DISPLAY DEVICE

(71) Applicants: WUHAN TIANMA MICROELECTRONICS CO., LTD, Wuhan (CN); WUHAN TIANMA MICROELECTRONICS CO., LTD. SHANGHAI BRANCH, Shanghai (CN)

(72) Inventors: Mengmeng Zhang, Shanghai (CN); Xingyao Zhou, Shanghai (CN); Yana Gao, Shanghai (CN)

(73) Assignees: WUHAN TIANMA MICROELECTRONICS CO., LTD, Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 0 days.

(21) Appl. No.: 17/359,686

(22) Filed: Jun. 28, 2021

(65) Prior Publication Data

US 2021/0327352 A1 Oct. 21, 2021

(30) Foreign Application Priority Data

Dec. 31, 2020 (CN) ..... 202011627150.7

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2310/0272* (2013.01); *G09G 2320/0233* (2013.01)

(58) Field of Classification Search
CPC ..... G09G 3/3233; G09G 3/3291; G09G 2310/0272; G09G 2320/0233
See application file for complete search history.

(56) References Cited

U.S. PATENT DOCUMENTS

2020/0394962 A1* 12/2020 Seo ..... G09G 3/3266
2021/0104196 A1* 4/2021 Yuan ..... G09G 3/3258
2021/0201817 A1* 7/2021 Kim ..... G09G 3/3266

FOREIGN PATENT DOCUMENTS

CN 107610651 A 1/2018
CN 109448616 A 3/2019
(Continued)

*Primary Examiner* — Stacy Khoo
(74) *Attorney, Agent, or Firm* — Kilpatrick Townsend & Stockton LLP

(57) ABSTRACT

Provided are a display panel, a driving method and a display device. The display panel includes a substrate, a sub-pixel disposed on one side of the substrate and a switch device. A first terminal of the switch device is electrically connected to a first terminal of a driving device, and a second terminal of the switch device is connected to a biased compensation voltage terminal. An image update period includes a data writing stage and a holding stage, and the holding stage includes a first stage and a second stage. The driving device generates a driving current according to a data voltage transmitted by the data writing device in the data writing stage; and the driving device provides the driving current to a light emitting element in the second stage. The switch device provides a biased compensation voltage to the first terminal of the driving device in the first stage.

21 Claims, 10 Drawing Sheets

(56) References Cited

FOREIGN PATENT DOCUMENTS

| | | | |
|---|---|---|---|
| CN | 110738965 | A | 1/2020 |
| CN | 111696460 | A | 9/2020 |
| CN | 111883055 | A | 11/2020 |
| CN | 112102785 | A | 12/2020 |
| CN | 112150967 | A | 12/2020 |

* cited by examiner

DISPLAY PANEL, DRIVING METHOD AND DISPLAY DEVICE

CROSS-REFERENCE TO RELATED APPLICATION(S)

This application claims priority to Chinese Patent Application No. 202011627150.7 filed Dec. 31, 2020, the disclosure of which is incorporated herein by reference in its entirety.

FIELD

Embodiments of the present disclosure relate to the field of display technologies, in particular, a display panel, a driving method and a display device.

BACKGROUND

A pixel circuit in an organic light emitting diode (OLED) display achieves a display function through a driving current flowing through an OLED and controlled by a driving transistor. A magnitude of the driving current is related to characteristic parameters of the driving transistor, such as a threshold voltage of the driving transistor.

In a display process of the existing OLED, when two different images are displayed, a process in which image brightness changes slowly exists in a switching process due to the difference of image brightness, and the brightness changing process takes a long period of time and is easy to be detected by human eyes, thus leading to the problem that some regions of an image are darker and causing a poor image display effect, and the problem is urgent to be solved and to improve the display quality of the OLED.

SUMMARY

The present disclosure provides a display panel, a driving method and a display device and to compensate for defects of unstable electrical performance of transistors during a display image switching, and reducing the problem that the brightness of part of an image is darker.

In one embodiment of the present disclosure provide a display panel, including a substrate, a sub-pixel disposed on one side of the substrate and a switch device.

The sub-pixel includes a pixel driving circuit and a light emitting element, and the pixel driving circuit includes a driving device and a data writing device.

A first terminal of the switch device is electrically connected to a first terminal of the driving device, and a second terminal of the switch device is connected to a biased compensation voltage terminal. The biased compensation voltage terminal is configured to transmit a biased compensation voltage.

The display panel further includes image update periods, each of the plurality of image update periods includes a data writing stage and a holding stage, and the holding stage includes a first stage and a second stage.

The driving device is configured to generate a driving current according to a data voltage transmitted by the data writing device in the data writing stage; and the driving device is further configured to provide the driving current to the light emitting element in the second stage.

The switch device is configured to provide the biased compensation voltage to the first terminal of the driving device in the first stage.

In another embodiment of the present disclosure further provide a driving method for display panel, which is applied to the display panel of any one of the embodiments and includes steps described below.

S1, in a data writing stage, a data writing device is turned on, a switch device is turned off, and a driving device provides a driving current to a light emitting element according to a data signal transmitted by a data writing device.

S2, in a first stage, the switch device is turned on, and the switch device provides a biased voltage to a first terminal of the driving device.

S3, in a second stage, the data writing device is turned off, the switch device is turned off, and the driving device continues to provide the driving current to the light emitting element.

In yet another embodiments of the present disclosure provide a display device, including the display panel of any one of the embodiments.

DETAILED DESCRIPTION

Figure 1:
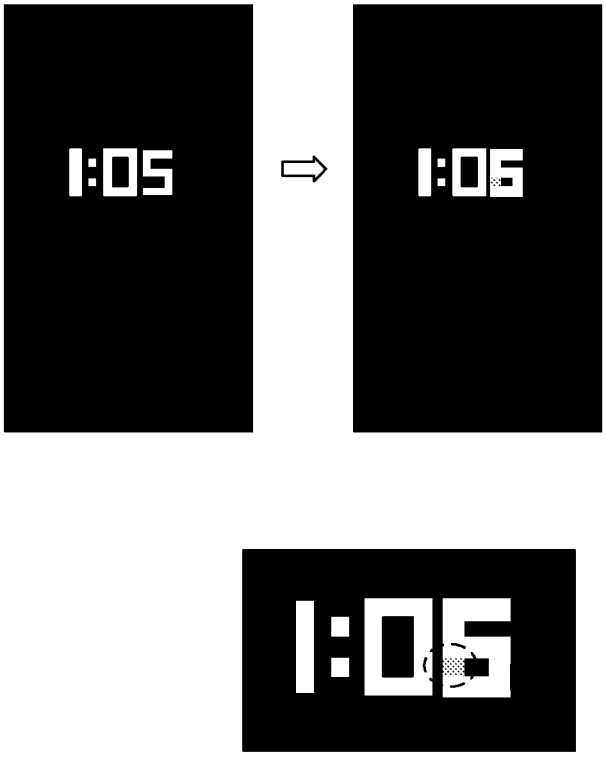
FIG. 1 is an effect diagram illustrating time image switch of an existing display panel.

Hereinafter the present disclosure will be further described in detail in conjunction with the drawings and embodiments. It is to be understood that the specific embodiments set forth herein are merely intended to illustrate and not to limit the present disclosure. Additionally, it is to be noted that for ease of description, merely part, not all, of the structures related to the present disclosure are illustrated in the drawings.

Figure 2:
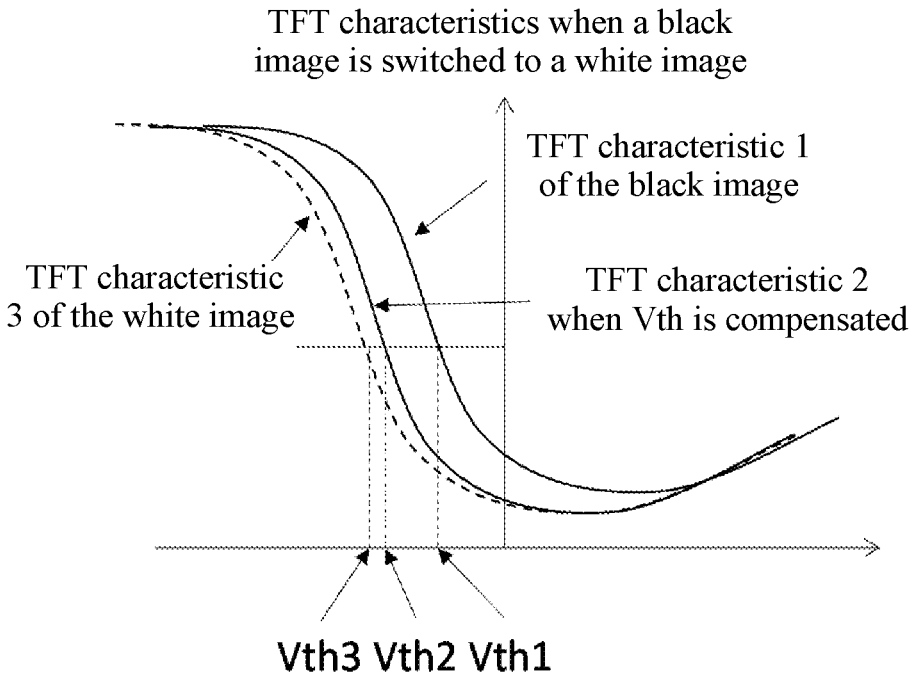
FIG. 2 illustrates characteristic curves of threshold voltages of a driving transistor in a normal state, a black state, and a white state in a pixel driving circuit of a display panel according to an embodiment of the present disclosure.

FIG. 1 is an effect diagram illustrating time image switch of a display panel in the related art. As shown in FIG. 1, in a time display image, when the display image is switched from 1:05 to 1:06, a part of the time display image (as shown in the enlarged region in the figure) needs to be switched from a black state to a white state. However, a problem that the brightness cannot reach normal white state brightness exists, that is, a display effect will be affected. FIG. 2 illustrates characteristic curves of threshold voltages of a driving transistor in a normal state, a black state, and a white state in a pixel driving circuit of a display panel according to an embodiment of the present disclosure. Referring to FIG. 2, the inventor has found that when a sub-pixel in the display image displays a black state, a gate-source voltage difference Vgs exists in a driving transistor M3 in a pixel driving circuit corresponding to the sub-pixel due to the writing of a data signal. In this case, the electrical performance of the driving transistor M3 is affected, causing a threshold voltage Vth of the driving transistor M3 to shift to the right shown in the figure. However, when a sub-pixel displays a white state, a gate-source voltage difference Vgs of a driving transistor M3 also changes due to the changes of the written data signal in a pixel driving circuit corresponding to the sub-pixel. In the normal state, when a white image is displayed, the threshold voltage Vth of the driving transistor M3 should be shifted to the left shown in the figure, and the sub-pixel displays preset white brightness. However, during the initial time period when the image is switched from the black state to the white state, the threshold voltage Vth of the driving transistor M3 is still shifted to the right shown in the figure due to hysteresis effect, resulting in an actual threshold voltage Vth of the driving transistor M3 shifting too much, and the gate-source voltage difference Vgs of the driving transistor M3 decreases after data is written. According to the principle that the brightness of the sub-pixel is controlled by the driving current and the driving current provided by the driving transistor M3 is positively correlated with the gate-source voltage difference Vgs, the brightness of the sub-pixel in the pixel driving circuit cannot reach the preset brightness due to the hysteresis effect of the driving transistor M3 at this time, thus affecting the display effect of the image.

Figure 3:
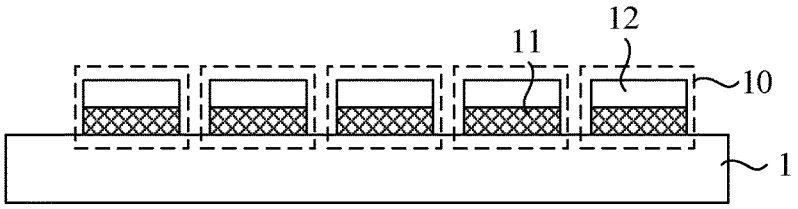
FIG. 3 is a structure view of a display panel according to an embodiment of the present disclosure.
Figure 4:
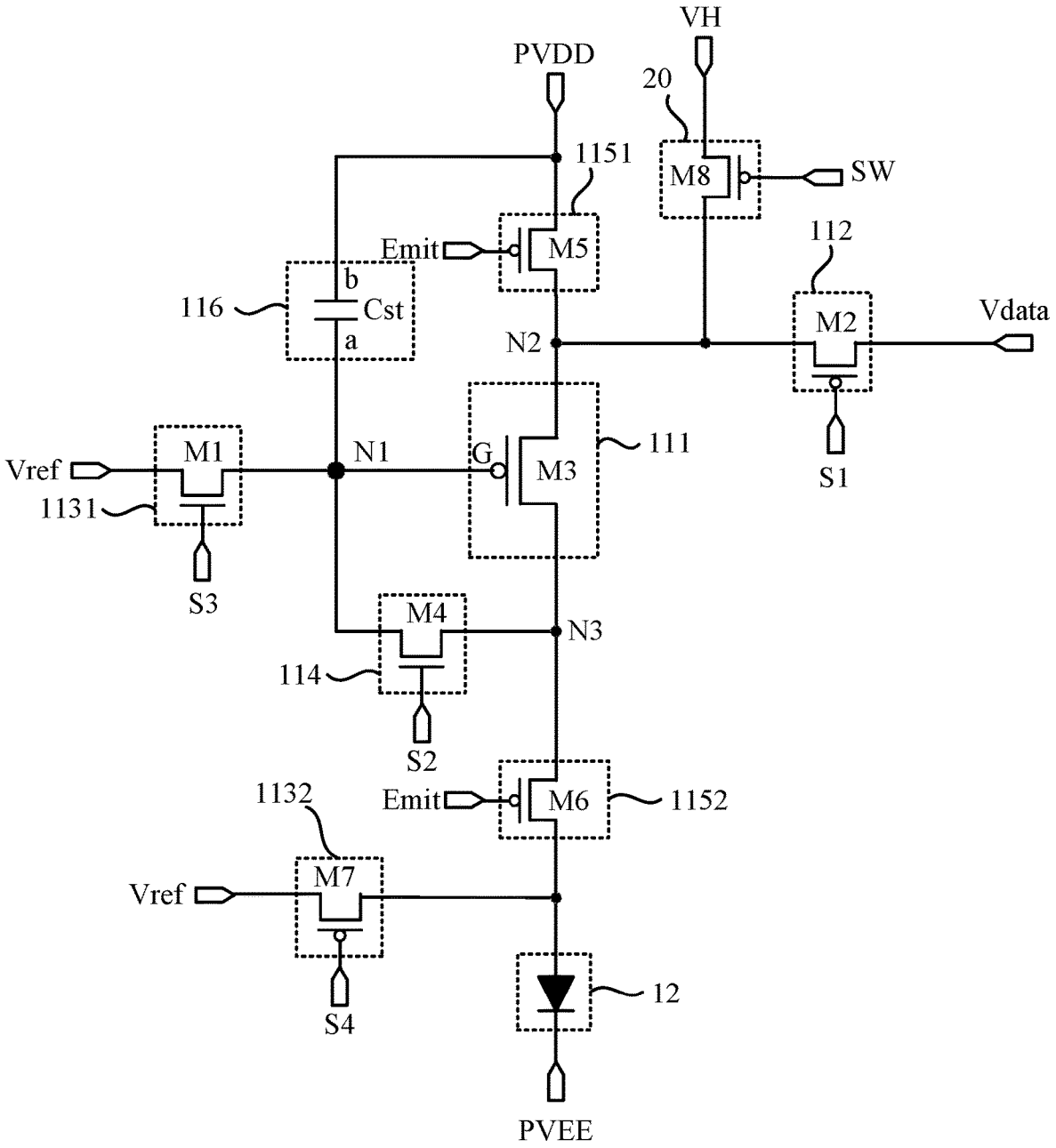
FIG. 4 is a circuit structure diagram of the sub-pixel shown in FIG. 3 and a switch device in the display panel.

Embodiments of the present disclosure provide a display panel and a driving method for the display panel. FIG. 3 is a structure view of a display panel according to an embodiment of the present disclosure; and FIG. 4 is a circuit structure diagram of a sub-pixel and a switch device in the display panel shown in FIG. 3. Referring to FIG. 3 and FIG. 4, the display panel includes a substrate 1, a sub-pixel 10 disposed on one side of the substrate 1, and a switch device 20. The sub-pixel 10 includes a pixel driving circuit 11 and a light emitting element 12, and the pixel driving circuit 11 includes a driving device 111 and a data writing device 112. A first terminal of the switch device 20 is electrically connected to a first terminal of the driving device 111, and a second terminal of the switch device 20 is connected to a biased compensation voltage terminal VH. The biased compensation voltage terminal VH is configured to transmit a biased compensation voltage.

The substrate 1 is typically made of a rigid glass substrate, or may also be made of a flexible organic material such as polyimide or polyethylene terephthalate. Sub-pixels 10 disposed on the substrate 1 can form image display through cooperation of colors and brightness of the sub-pixels 10. Brightness adjustment of the sub-pixel 10 is controlled by the pixel driving circuit 11, and the pixel driving circuit 11 is configured to provide a driving current to the light emitting element 12, and the light emitting element 12 displays certain brightness according to the magnitude of the driving current. Simply put, the data writing device 112 in the pixel driving circuit 11 of this embodiment is configured to write a data signal, and the driving device 111 is configured to drive, according to the data signal, the light emitting element 12 to emit light. As shown in FIG. 4, the driving device 111 is typically provided with a driving transistor M3, and the driving transistor M3 is configured to provide the driving current.

In this embodiment, the substrate 1 is further provided with the switch device 20, and two terminals of the switch device 20 are connected to the driving device 111 and the biased compensation voltage terminal VH, respectively. The switch device 20 can be controlled to provide the biased compensation voltage to the driving device 111, and stabilizing the electrical performance of the driving device 111. In an embodiment, a threshold voltage Vth of the driving transistor M3 can be adjusted through the biased compensation voltage, and the threshold voltage Vth of the driving transistor M3 can be adjusted in advance before the light emitting element 12 is driven to emit light, and reducing the offset of the threshold voltage Vth and improving the driving effect of the driving device 111.

In this embodiment, the display panel in a driving display process may include image update periods, and each of the plurality of image update periods includes a data writing stage and a holding stage. The holding stage includes a first stage and a second stage. The driving device 111 is configured to, in the data writing stage, generate a driving current according to a data voltage transmitted by the data writing device 112; and the driving device 111 is further configured to, in the second stage, provide the driving current to the light emitting element 12. The switch device 20 is configured to provide the biased compensation voltage to the first terminal of the driving device 111 in the first stage.

In an embodiment, the display panel fixedly displays one image per image update period. Microscopically, the image displayed by the display panel is essentially a process of emitting light by the plurality of sub-pixels 10 provided in the display panel. Macroscopically, the plurality of sub-pixels 10 can display one image through the cooperation of colors and brightness of the plurality of sub-pixels 10. One image update period of the display panel may essentially include multiple frames of the same image, and each frame of image is a process in which all sub-pixels 10 in the display panel are driven and lit by corresponding pixel driving circuits, respectively. In other words, each pixel driving circuit 11 in the display panel refreshes once in one frame of image of the display panel. In a refreshing process of the pixel driving circuit 11, a data signal is written by the data writing device 112, and the light emitting element 12 is driven to emit light by the driving device 111, and achieving one light-emitting driving of the sub-pixel 10; namely, the foregoing is a data writing stage in one image update period, and may also be understood as a data refresh frame. However, in the refresh process of the pixel driving circuit, when only the light emitting element 12 is driven to emit light by the driving device 111 and the data signal is not written by the data writing device 112, so that one light emitting driving of the sub-pixel 10 is achieved; namely, the foregoing is a holding stage in one image update period, and may also be understood as a holding frame. It is to be understood that the hold stage essentially is that the light emitting element is driven to emit light according to the data signal stored in the data writing stage since the data signal is not re-written through the data writing device 112.

In one embodiment, as shown in FIG. 4, the driving circuit of the sub-pixel of the display panel uses a circuit structure of 7T1C. The pixel driving circuit includes the driving device 111 and the data writing device 112, and the pixel driving circuit further includes a first reset device 1131, a threshold compensation device 114, a first light emitting control device 1151, a storage device 116, a second reset device 1132 and a second light emitting control device 1152. The threshold compensation device 114 is configured to compensate a threshold voltage of the driving device 111. The first light emitting control device 1151 is configured to provide a first power supply signal PVDD to the first terminal of the driving device 111. The second light emitting control device 1152 is configured to control the driving current generated by the driving device 111 to be transmitted to the light emitting element 12. The first reset device 1131 is configured to provide a first reset signal to a control terminal of the driving device 111. The second reset device 1132 is configured to provide a second reset signal to an anode of the light emitting element 12.

A control terminal of the data writing device 112 is electrically connected to a first scanning signal terminal S1, a first terminal of the data writing device 112 is electrically connected to the first terminal of the driving device 111, and a second terminal of the data writing device 112 is electrically connected to a data signal terminal Vdata. A control terminal of the threshold compensation device 114 is electrically connected to a second scanning signal terminal S2, a first terminal of the threshold compensation device 114 is electrically connected to a second terminal of the driving device 111, and a second terminal of the threshold compensation device 114 is electrically connected to the control terminal of the driving device 111. A control terminal of the first light emitting control device 1151 is electrically connected to a light emitting control signal terminal Emit, a first terminal of the first light emitting control device 1151 is electrically connected to a first power supply signal terminal PVDD, and a second terminal of the first light emitting control device 1151 is electrically connected to the first terminal of the driving device 111. A control terminal of the second light emitting control device 1152 is electrically connected to the light emitting control signal terminal Emit, a first terminal of the second light emitting control device 1152 is electrically connected to the second terminal of the driving device 111, and a second terminal of the second light emitting control device 1152 is electrically connected to the anode of the light emitting element 12. A cathode of the light emitting element 12 is electrically connected to a second power supply signal terminal PVEE. A control terminal of the first reset device 1131 is electrically connected to a third scanning signal terminal S3, a first terminal of the first reset device 1131 is electrically connected to a reset signal terminal Vref, and a second terminal of the first reset device 1131 is electrically connected to the control terminal of the driving device 111. A control terminal of the second reset device 1132 is electrically connected to a fourth scanning signal terminal S4, a first terminal of the second reset device 1132 is electrically connected to the reset signal terminal Vref, and a second terminal of the second reset device 1132 is electrically connected to the anode of the light emitting element 12.

It is to be noted that the embodiment of the present disclosure does not specifically limit the specific structures of the switching device, the driving device, the reset device, the data writing device, the threshold compensation device and the light emitting control device. On the premise that the biased compensation function on the threshold voltage of the driving transistor can be achieved, each device of the pixel driving circuit may be designed according to actual needs. For convenience of understanding, specific structures of the switch device, the driving device, the reset device, the data writing device, the threshold compensation device and the light emitting control device are illustrated in the following embodiments of the present disclosure, where each device may include a thin film transistor. Referring to FIG. 4, the switch device 20 may be provided with an eighth transistor M8, a gate of the eighth transistor M8 is electrically connected to a gating signal line SW, one terminal of the eighth transistor M8 is electrically connected to a biased compensation voltage signal line VH, and another terminal of the eighth transistor M8 is electrically connected to the data writing device 112. The first reset device 1131 may be provided with a first transistor M1, and a gate of the first transistor M1 is electrically connected to the third scanning signal terminal S3. In a reset period a, a third scanning signal controls the first transistor M1 to be turned on, and at this time, the reset signal terminal Vref resets a first node N1 through the first transistor M1. In a non-reset period, the third scanning signal controls the first transistor M1 to be turned off. The data writing device 112 includes a second transistor M2, and the threshold compensation device 114 includes a fourth transistor M4. A gate of the second transistor M2 is electrically connected to the first scanning signal terminal S1, and a gate of the fourth transistor M4 is electrically connected to the second scanning signal terminal S2. In a data voltage writing period b, a first scanning signal controls the second transistor M2 to be turned on, and a second scanning signal S2 controls the fourth transistor M4 to be turned on. At this time, the data signal terminal Vdata writes a threshold compensated data voltage signal to the first node N1 through the second transistor M2, the driving transistor M3 and the fourth transistor M4. In a non-data writing period, the first scanning signal S1 and the second scanning signal S2 control the second transistor M2 and the fourth transistor M4 to be turned off, respectively. In the light emitting control device, the first light emitting control device 1151 may be provided with a fifth transistor M5, the second light emitting control device 1152 may be provided with a sixth transistor M6, and a gate of the fifth transistor M5 and a gate of the sixth transistor M6 are both electrically connected to the light emitting control signal terminal Emit. In a light emitting period, a light emitting control signal controls the fifth transistor M5 and the sixth transistor M6 to be turned on. At this time, the power supply signal terminal PVDD, the fifth transistor M5, the driving transistor M3, the sixth transistor M6 and the light emitting element 12 form a conduction passage, and the driving transistor M3 generates a driving current to drive the light emitting element 12 to emit light. In a non-light emitting period, the light emitting control signal controls the fifth transistor M5 and the sixth transistor M6 to be turned off.

In one embodiment, the switch device may further be provided with a capacitor, and in the first stage, the capacitor enables a voltage signal provided by the biased compensation voltage terminal to jump from a first potential to a second potential, and the biased compensation voltage is transmitted to an N2 node, and achieving the biased voltage compensation for the driving device.

It is to be noted that the transistors of the above devices and the driving transistors may be N-type transistors or P-type transistors, may be silicon-based transistors, such as a-Si transistors, P-Si transistors, LTPS transistors, or may be oxide transistors, such as indium gallium zinc oxide IGZO transistors, may be used, which are not limited in the embodiments of the present disclosure. Exemplarily, in this embodiment, both the threshold compensation device and the first reset device may include oxide transistors, that is the first transistor M1 and the fourth transistor M4 are IGZO transistors and may be provided as N-type transistors. However, the second transistor M2, the third transistor M3, the fifth transistor M5, the sixth transistor M6, the seventh transistor M7 and the eighth transistor M8 may all be LTPS transistors, and may be P-type transistors.

Further, in the display panel, the first scanning signal terminal S1 and the second scanning signal terminal S2 may be configured to receive the same control signal. In this case, the data writing device 112 and the threshold compensation device 114 may be turned on or off synchronously. In the data writing period, the data writing device 112 and the threshold compensation device 114 may be controlled to be turned on synchronously by using the same valid potential signal, and a data signal is written to the gate of the driving transistor M3.

Figure 5:
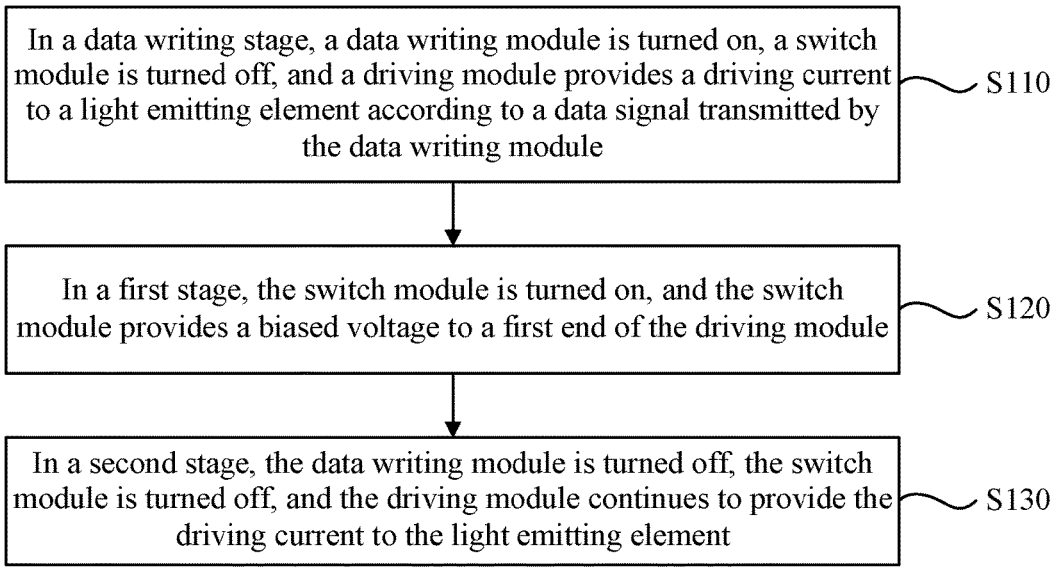
FIG. 5 is a flowchart of a method for driving a display panel according to an embodiment of the present disclosure.
Figure 6:
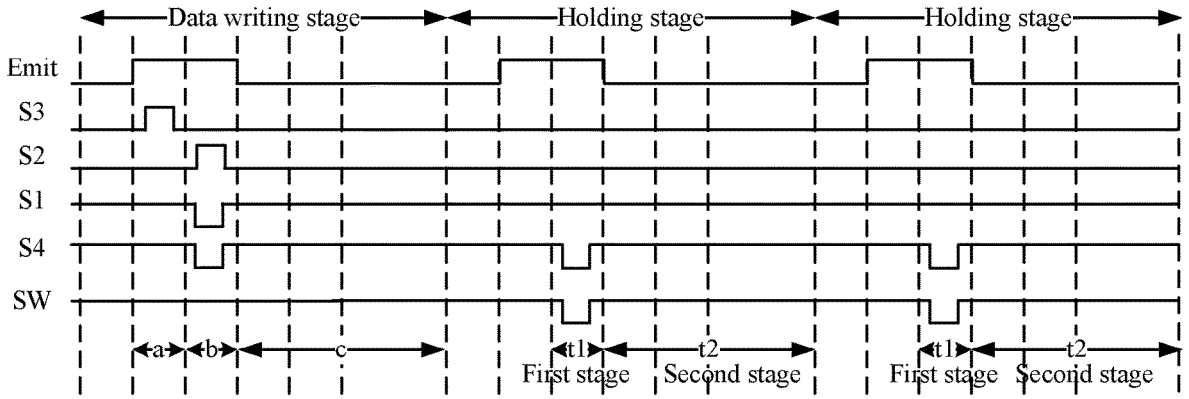
FIG. 6 is a driving timing diagram of the display panel shown in FIG. 4.

FIG. 5 is a flowchart of a driving method for the display panel according to an embodiment of the present disclosure. FIG. 6 is a driving timing diagram of the display panel shown in FIG. 4. Hereinafter referring to FIG. 3 to FIG. 6, the driving method for the display panel provided by the embodiment of the present disclosure is described in detail. As shown in FIG. 5, the driving method for the display panel includes steps described below.

S1, in a data writing stage, a data writing device is turned on, a switch device is cut off, and a driving device provides a driving current to a light emitting element according to a data signal transmitted by the data writing device.

Referring to FIG. 4 and FIG. 6, in one embodiment, the data writing stage includes a reset period a, a data voltage writing period b, and a light emitting period c. In the reset period a, the third scanning signal S3 controls the first reset device 1131 to be turned on, and the first reset device 1131 provides the first reset signal from the reset signal terminal Vref to the first node N1, so that a signal stored in the storage capacitor Cst and the gate G of the driving transistor M3 can be reset. This period is actually a process of resetting the storage capacitor Cst and the gate G of the driving transistor M3 and to eliminate a data voltage signal existing in the storage capacitor Cst and the gate G of the driving transistor M3 of a last frame of display image. In this way, each light emitting element 12 is reset and then driven to emit light in each light emitting driving process, and ensuring the uniformity of the light emitting control of each light emitting element 12, and ensuring the uniformity of the light emitting brightness.

In the data voltage writing period b, the first scanning signal S1 controls the data writing device 112 to be turned on, the second scanning signal S2 controls the threshold compensation device 114 to be turned on, and a data voltage signal from the data signal terminal Vdata is written to the first node N1, that is, a first electrode plate a of the storage capacitor Cst and the gate G of the driving transistor M3, sequentially through the data writing device 112, the driving transistor M3 and the threshold compensation device 114. In this way, a voltage of the gate of the driving transistor M3 is gradually increased until a voltage difference between the voltage of the gate of the driving transistor M3 and a voltage of the first terminal of the driving transistor M3 is equal to a threshold voltage of the driving transistor M3, and the driving transistor M3 is turned off.

Under the control of the data writing device 112, the data voltage signal from the data signal terminal Vdata charges the first electrode plate a of the storage capacitor Cst through the driving transistor M3, and to ensure that the first node N1 reaches a preset potential value compensated by a threshold. At this time, the voltage of the first node N1 is Vdata−|Vth|, where Vdata is the data voltage of the data signal terminal and Vth is the threshold voltage of the driving transistor M3.

It is to be noted that in an embodiment, an enabled stage of the data writing device does not overlap with an enabled stage of the first light emitting control device and an enabled stage of the second light emitting control device, that is, a valid signal of the first scanning signal S1 shown in the figure does not overlap with a valid signal of the light emitting control signal Emit. In this case, in the data writing period, the first light emitting control device 1151 and the second light emitting control device 1152 can be ensured to be turned off, so that the data writing process is prevented from being affected by the power supply signal PVDD or the light emitting element 12.

In the light emitting period c, the light emitting control signal Emit controls the first light emitting control device 1151 and the second light emitting control device 1152 to be turned on, the driving current generated by the driving transistor M3 flows into the light emitting element 12, and the light emitting element 12 emits light in response to the driving current. It is to be understood that since the data voltage signal is stored in the first node N1, and the source-gate voltage difference Vgs of the driving transistor M3 is Vgs=VDD−(Vdata−|Vth|), which may result in the offset of the threshold voltage of the driving transistor M3.

S2, in a first stage, the switch device is turned on, and the switch device provides a biased voltage to a first terminal of the driving device.

Referring to FIG. 4 and FIG. 6, in the first stage, a control signal is provided to the switch device 20 through a gating signal line SW, and the switch device 20 is turned on, and the biased compensation voltage terminal VH can transmit the biased compensation voltage VH to the source of the driving transistor M3, that is, the second node N2, through the switch device 20. In this case, the gate-source voltage difference of the drive transistor M3 is Vgs=(Vdata−|Vth|)−VH. An appropriate biased compensation voltage VH is provided to the second node N2, and that gate-source voltage difference of the driving transistor M3 can be adjusted. In the data writing stage, the offset of the threshold voltage caused by the gate-source voltage difference can make the threshold voltage to reversely offset, and reducing the offset of the threshold voltage and improving the electrical performance of the driving transistor M3.

S3, in a second stage, the data writing device is turned off, the switch device is turned off, and the driving device continues to provide the driving current to the light emitting element.

Referring to FIG. 4 and FIG. 6, in the second stage, a control signal is provided to the switch device 20 through the gating signal line SW and the switch device 20 is turned off; and at the same time, the first light emitting control device 1151 and the second light emitting control device 1152 are controlled to be turned on, the data signal stored in the first node N1 of the driving transistor M3 can still be utilized to generate the driving current and the driving current flows into the light emitting element 12 and light emitting is achieved. Apparently, in the second stage, since the offset of the threshold voltage of the driving transistor M3 is relatively reduced, the electrical performance tends to be normal, and the brightness of the light emitting element 12 driven by the driving transistor M3 can be closer to the preset brightness, and ensuring the display accuracy.

As can be seen from the driving process of the pixel driving circuit, in the embodiments of the present disclosure, the display panel includes the switch device, the first terminal of the switch device is electrically connected to the first terminal of the driving device, and the second terminal of the switch device is connected to the biased compensation voltage terminal and to transmit the biased compensation voltage. In addition, the image update period includes the data writing stage and the holding stage, and the holding stage includes the first stage and the second stage. The driving device is configured to generate the driving current according to the data voltage transmitted by the data writing device in the data writing stage; and the driving device is further configured to provide the driving current to the light emitting element in the second stage. The switch device is configured to provide the biased compensation voltage to the first terminal of the driving device in the first stage, and the phenomenon of offset of the biased voltage of the driving transistor caused by the data writing stage is compensated by utilizing the first stage. Embodiments of the present disclosure solve the problem that the brightness of the existing display panel is insufficient due to the hysteresis effect of the driving transistor, and reducing the offset of the biased voltage of the driving transistor in advance, improving the electrical performance of the driving transistor, ensuring the accuracy of the light emitting brightness in a light emitting stage, and improving the display effect of the display panel during the image switching.

It is to be noted that the above driving method for the display panel is suitable for each image update period and also suitable for a specific image update period. The additionally arranged switch device is utilized to provide the biased compensation voltage to the driving device and to improve the biased voltage of the driving transistor, and ensuring the accuracy of the light emitting brightness of the light emitting element, and adjusting the display effect during the image switching. The driving process of the display panel under two different image switching conditions is specifically analyzed and described in detail.

On the basis of the above embodiments in the plurality of image update periods of the display panel, target brightness corresponding to the sub-pixel in an i-th image update period is referred to as first brightness, target brightness corresponding to the sub-pixel in an i+1-th image update period is referred to as second brightness, and the first brightness is less than the second brightness. i is a natural number greater than or equal to 1, and the i+1-th image update period is an image update period after the i-th image update period. The switch device 20 may be configured to provide a first biased compensation voltage to the first terminal of the driving device in the first stage of the i-th image update period, where V1≥Vpvdd+VB−VW. V2 is the first biased compensation voltage, Vpvdd is a voltage of the first terminal of the driving device in the second stage, VB is the data voltage transmitted by the data writing device in the data writing stage of the i-th image update period, and VW is the data voltage transmitted by the data writing device in the data writing stage of the i+1-th image update period.

For ease of description, for a single sub-pixel, if the brightness of the i-th image update period is less than the brightness of adjacent i+1-th image update period, the i-th image update period may be understood as a black state image update period, and the i+1-th image update period may be understood as a white state image update period. Still referring to FIG. 2 and FIG. 4, in the black state image update period, the threshold voltage Vth of the driving transistor corresponding to the sub-pixel is shifted to the right due to the existence of the gate-source voltage difference Vgs. However, in this embodiment, in the first stage of the i-th image update period, the switch device 20 is utilized to provide the first biased compensation voltage V1 to the first terminal of the driving device 111 and the driving transistor M3 has different gate-source voltages through the first biased compensation voltage V1, so that the driving transistor is inversely offset with the gate-source voltage, and reducing the offset of the threshold voltage Vth of the driving transistor.

In this embodiment, the first biased compensation voltage V1 should be set to be less than or equal to Vpvdd+VB−VW. For the sub-pixel in the black state image update period, in the data writing stage, a data signal is written to the gate of the driving transistor M3, and at this time, the potential of the node N1 is VB−|Vth|. Therefore, the source-gate voltage difference of the P-type driving transistor M3 is Vsg=Vpvdd−(VB−|Vth|), and at this time, the threshold voltage Vth of the driving transistor M3 is shifted to the right due to the existence of the source-gate voltage difference. However, the holding stage is provided with the first stage, the switch device 20 is utilized to provide the first biased compensation voltage V1 to the first terminal of the driving device 111, and V1 is set to be V1≥Vpvdd+VB−VW. Apparently, at this time, the source-gate voltage difference of the driving transistor M3 is Vsg=V1−(VB−|Vth|), and an inequation about V1 is substituted and to obtain an inequation: Vsg≥Vpvdd+VB−VW−(VB−|Vth|)=Vpvdd−(VW−|Vth|). It is to be understood that the voltage difference Vpvdd−(VW−|Vth|) is essentially the source-gate voltage difference Vsg in the white state image update period. Therefore, in the first stage of the black state image update period, the first terminal of the driving device 111 is provided with the first biased compensation voltage V1 and the source-gate voltage difference of the driving transistor M3 is greater than the source-gate voltage difference in a next white state image update period. In other words, the driving transistor M3 may be provided with an equal or greater source-gate voltage difference before a next white state image update period, and the threshold voltage Vth of the driving transistor M3 can be reversely offset in advance with the source-gate voltage difference, that is, the threshold voltage Vth of the driving transistor M3 can be shifted to the right less in the white state image update period, and ensuring that the electrical performance of the driving transistor M3 in the white state image update period is in a normal state, and achieving normal white state image display.

Similarly in the plurality of image update periods of the display panel, the target brightness corresponding to the sub-pixel in the i-th image update period is referred to as the first brightness, the target brightness corresponding to the sub-pixel in the i+1-th image update period is referred to as the second brightness, and the first brightness is greater than the second brightness. i is a natural number greater than or equal to 1, and the i+1-th image update period is the image update period after the i-th image update period. The switch device may be configured to provide a second biased compensation voltage to the first terminal of the driving device in the first stage of the i-th image update period, where V2≤Vpvdd+VW−VB. V2 is the second biased compensation voltage, Vpvdd is a potential of the first terminal of the driving device in the second stage, VW is the data voltage transmitted by the data writing device in the data writing stage of the i-th image update period, and VB is the data voltage transmitted by the data writing device in the data writing stage of the i+1-th image update period.

Similarly, for ease of description, for a single sub-pixel, if the brightness of the i-th image update period is greater than the brightness of adjacent i+1-th image update period, the i-th image update period may be understood as the white state image update period, and the i+1-th image update period may be understood as the black state image update period. Still referring to FIG. 2 and FIG. 4, in the white state image update period, the threshold voltage Vth of the driving transistor corresponding to the sub-pixel is shifted to the left due to the existence of the gate-source voltage difference Vgs. However, in this embodiment, in the first stage of the i-th image update period, the switch device 20 is utilized to provide the second biased compensation voltage V2 to the first terminal of the driving device 111 and the driving transistor M3 has different gate-source voltages through the second biased compensation voltage V2, so that the driving transistor is inversely offset with the gate-source voltage, and reducing the offset of the threshold voltage Vth of the driving transistor.

In this embodiment, the second biased compensation voltage V2 should be set to be less than or equal to Vpvdd+VW−VB. For the sub-pixel in the black state image update period, in the data writing stage, a data signal is written to the gate of the driving transistor M3, and at this time, the potential of the node N1 is VW−|Vth|. Therefore, the source-gate voltage of the P-type driving transistor M3 is Vsg=Vpvdd−(VW−|Vth|), and at this time, the threshold voltage Vth of the driving transistor M3 is shifted to the left due to the existence of the source-gate voltage. However, the holding stage is provided with the first stage, the switch device 20 is utilized to provide the second biased compensation voltage V2 to the first terminal of the driving device 111, and V2 is set to be V2≤Vpvdd+VW−VB. Apparently, at this time, the source-gate voltage of the driving transistor M3 is Vsg=V2−(VW−|Vth|), and an inequation is obtained: Vsg≤Vpvdd+VW−VB−(VW−|Vth|)=Vpvdd−(VB−|Vth|). It is to be understood that the voltage difference Vpvdd−(VB−|Vth|) is essentially the source-gate voltage Vsg of the black state image update period. Therefore, in the first stage of the white state image update period, the first terminal of the driving device 111 is provided with the second biased compensation voltage V2 and the source-gate voltage of the driving transistor M3 is less than the source-gate voltage difference of a next black state image update period. In other words, the driving transistor M3 may be provided with an equal or less source-gate voltage difference before a next black state image update period, and the threshold voltage Vth of the driving transistor M3 can be reversely offset in advance with the source-gate voltage difference, that is, the threshold voltage Vth of the driving transistor M3 can be shifted to the left less in the black state image update period, and ensuring that the electrical performance of the driving transistor M3 in the black state image update period is in a normal state, and achieving normal black state image display.

Based on the above two specific implementing processes, the present disclosure further provides another driving method for the display panel. In the plurality of image update periods of the display panel, the target brightness corresponding to the sub-pixel in the i-th image update period is the first brightness, the target brightness corresponding to the sub-pixel in the i+1-th image update period is the second brightness, i is a natural number greater than or equal to 1, and the i+1-th image update period is the image update period after the i-th image update period. The driving method for the display panel includes steps described below.

Whether the first brightness is less than the second brightness is determined.

If the first brightness is less than the second brightness, the switch device provides a first biased compensation voltage to the first terminal of the driving device in a first stage of the i-th image update period, where V1≥Vpvdd+VB−VW, V1 is the first biased compensation voltage, Vpvdd is a voltage of the first terminal of the driving device in a second stage, VB is a data voltage transmitted by the data writing device in a data writing stage of the i-th image update period, and VW is a data voltage transmitted by the data writing device in a data writing stage of the i+1-th image update period.

If the first brightness is greater than the second brightness, the switch device provides a second biased compensation voltage to the first terminal of the driving device in a first stage of the i-th image update period, where V2≤Vpvdd+VW−VB, V2 is the second biased compensation voltage, Vpvdd is a potential of the first terminal of the driving device in a second stage, VW is a data voltage transmitted by the data writing device in a data writing stage of the i-th image update period, and VB is a data voltage transmitted by the data writing device in a data writing stage of the i+1-th image update period.

Figure 7:
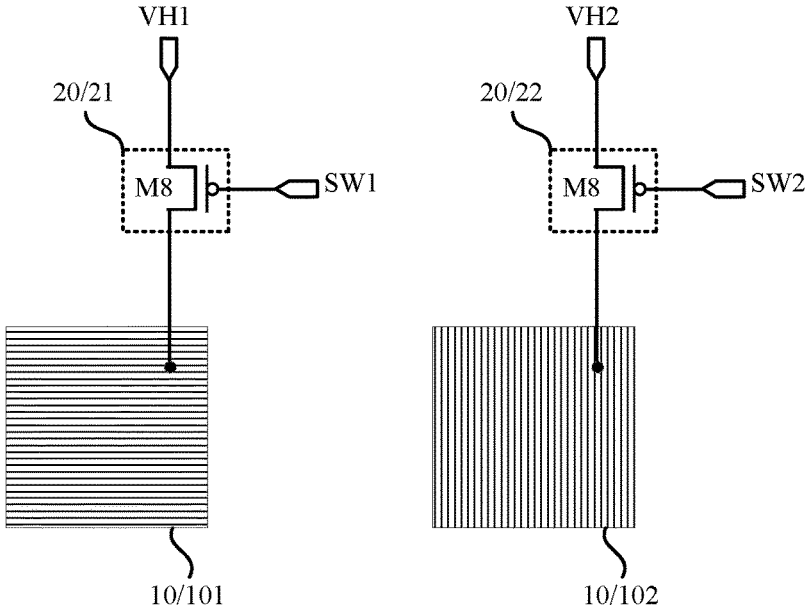
FIG. 7 is a partial circuit structure diagram of another display panel according to an embodiment of the present disclosure.

In addition, the embodiment of the present disclosure studies and analyzes biased compensation voltages of different color sub-pixels in the same display panel. FIG. 7 is a partial circuit structure diagram of another display panel according to an embodiment of the present disclosure. Referring to FIG. 4 and FIG. 7, in an embodiment, the plurality of sub-pixels 10 may be set to include a first color sub-pixel 101 and a second color sub-pixel 102. A data voltage transmitted by a data writing device 112 in the first color sub-pixel 101 is a first data voltage Vdata1, and a data voltage transmitted by a data writing device 112 in the second color sub-pixel 102 is a second data voltage Vdata2, where Vdata1≤Vdata2. Switch devices 20 are provided, biased compensation voltage terminals VH are provided, and the plurality of switch devices 20 are in one-to-one correspondence with the plurality of biased compensation voltage terminals VH. The plurality of switch devices 20 include a first switch device 21 and a second switch device 22, a biased compensation voltage terminal electrically connected to a second terminal of the first switch device 21 is a first biased compensation voltage terminal VH1, and a biased compensation voltage terminal electrically connected to a second terminal of the second switch device 22 is a second biased compensation voltage terminal VH2. The first biased compensation voltage terminal VH1 is configured to transmit a third biased compensation voltage V3, and the second biased compensation voltage terminal VH2 is configured to transmit a fourth biased compensation voltage V4, where V3>V4.

It is to be understood that for the first color sub-pixel 101 and the second color sub-pixel 102, driving currents corresponding to the light emitting brightness are different due to different light emitting elements, that is, data signals written to the corresponding pixel driving circuits are different. On the basis that a data voltage Vdata1 of the first color sub-pixel 101 is less than a data voltage Vdata2 of the second color sub-pixel 102, that is, source-gate voltage differences Vsg of the corresponding driving transistors of the two sub-pixels in the data writing stage are different. According to the source-gate voltage difference formula Vsg=Vpvdd−(Vdata−|Vth|), the source-gate voltage difference is negatively correlated with the data voltage, and the source-gate voltage difference Vsg1 of the first color sub-pixel 101 is greater than the source-gate voltage difference Vsg2 of the second color sub-pixel 102. On this basis, comparatively speaking, the offset of the threshold voltage Vth of the driving transistor corresponding to the first color sub-pixel 101 is more severe. Therefore, in this embodiment, the first switch device 21 and the second switch device 22 are utilized to input the third biased compensation voltage V3 and the fourth biased compensation voltage V4, respectively, so that the threshold voltages of the driving transistors corresponding to the two sub-pixels can be inverted, respectively, and reducing the offset and making the driving transistors tend to be normal. Moreover, the third biased compensation voltage V3 is set to be greater than the fourth biased compensation voltage V4 and bias adjustment degree of the driving transistor corresponding to the first color sub-pixel 101 can be increased, so that the threshold voltage Vth of the driving transistor is inverted more quickly, and balancing the offset of the threshold voltages of the driving transistors corresponding to the first color sub-pixel and the second color sub-pixel, and enabling the light emitting brightness of the sub-pixels of different colors to be more accurate and uniform.

Furthermore, considering that the display panel has different driving modes for the actual display, the embodiment of the present disclosure further provides another driving method for the display panel. On the basis of the driving method for the display panel provided by the above embodiment the driving method for the display panel may further include steps described below.

S01, a driving mode of the display panel is determined.

In an embodiment, this step may include that if an image update period frequency of the display panel is less than or equal to 15 Hz, determining the driving mode as a low-frequency driving mode, otherwise, determining the driving mode as a high-frequency driving mode.

The image update period frequency being less than or equal to 15 Hz indicates that the number of image switches of the display panel in one second is less than 15 and the maintenance time of each image is 1/15 second. In this case, the display panel maintains the same image for a long time, which is relatively not smooth in terms of human eyes' senses, and the human eyes are sensitive to the brightness in the process of image switching.

S02, when the driving mode is the low-frequency driving mode, steps S1, S2 and S3 are executed.

When the driving mode of the display panel is determined to be the low-frequency driving mode, compared with the high-frequency driving, the display panel in the low-frequency driving has a longer image display time, and the driving transistor is affected by the gate-source voltage difference for a long period of time after the data signal is written in each image update period, and thus the offset of the threshold voltage is generated. Steps S1, S2 and S3 are executed and the switch device in step S2 is utilized to provide a biased voltage to the first terminal of the driving device, so that the threshold voltage of the driving transistor is reversely shifted and the offset of the driving transistor is reduced, and ensuring that the electrical performance of the driving transistor tend to be normal and the accurate display.

S03, when the driving mode is the high-frequency driving mode, step S4 is executed.

S4, in a data writing stage, the data writing device is turned on, the switch device is turned off, and the driving device provides the driving current to the light emitting element according to a data voltage transmitted by the data writing device; and in a holding stage, the data writing device is turned off and the switch device is turned off.

It is to be understood that in the high-frequency driving mode, since the frequency of the image update period is high, the time of each image update period is short, and the human eye has poor perception of the brightness of each image, and thus the threshold voltage offset of the driving transistor and the hysteresis effect have little influence on the display effect. In this case, the switch device is configured to be turned off in the holding stage, so that the control times of the switch device can be reduced, and the power consumption can be reduced to a certain extent.

Figure 8:
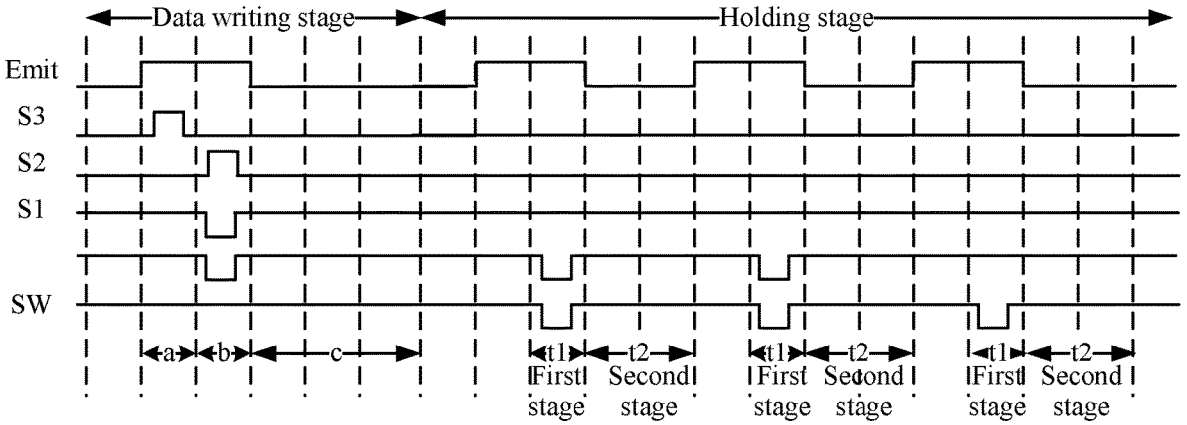
FIG. 8 is a driving timing diagram of a sub-pixel of another display panel according to an embodiment of the present disclosure.

In addition, on the basis of performing bias compensation adjustment on the threshold voltage of the driving transistor in the first stage before the second stage, that is, before the light emitting holding in the second stage, in other embodiments of the present disclosure, a position of the first stage in the whole image update period can be flexibly adjusted, and even the number of first stages can be flexibly set. In an embodiment, FIG. 8 is a driving timing diagram of a sub-pixel of another display panel according to an embodiment of the present disclosure. Referring to FIG. 4 and FIG. 8 the holding stage includes first stages and second stages, the first stages and the second stages are arranged periodically at intervals; and the switch device 20 is configured to provide the biased compensation voltage to the first terminal of the driving device 111 in each of the first stages.

The first stages t1 and the second stages t2 are arranged periodically at intervals, which essentially could be understood that the light emitting element 12 is driven to emit light at intervals in the holding stage, and in an interval of light emitting, the threshold voltage of the driving transistor in the driving device 111 is compensated and adjusted through the switch device 20. It is to be understood that the first stage t1 is a threshold voltage bias adjustment stage and the second stage t2 is a light emitting holding stage, the light emitting holding stage and the threshold voltage bias adjustment stage in the holding stage are alternately arranged, not only can the threshold voltage of the driving transistor be biasedly compensated by using threshold voltage bias adjustment stages, but also that light emitting exists in an early period, a middle period and a later period in the whole holding stage can be ensured. Compared with the case where the light emitting holding stage is located at the later period of the whole holding stage and the threshold voltage bias adjustment stage is located at the early period of the whole holding stage, the light emitting element being in a dark state for a long period of time in the holding stage can be avoided, and preventing the sub-pixel from flickering.

Still referring to FIG. 4 and FIG. 8, further the switch device 20 may be configured to provide a biased compensation voltage VH to the first terminal of the driving device 111 at each first stage t1. In each first stage t1, an enabled stage of the second reset device 1132 is located within an enabled stage of the switch device 20.

The enabled stage of the second reset device 1132 is a valid potential stage of the fourth scanning signal S4, and the enabled stage of the switch device 20 is a valid potential stage of the gating signal SW. It is to be understood that the threshold voltage bias adjustment of the switch device 20 on the driving transistor M3 should be in a non-light emitting stage, that is, in each first stage t1, the enabled stage of the switch device 20 need to be arranged within a time period when the first light emitting control device 1151 and the second light emitting control device 1152 are turned off. At the same time, the reset of the second reset device 1132 is a reset process for an anode potential of the light emitting element 12 during the light emitting period of the second stage t2, which can ensure that the light emitting element 12 is not affected by the signal of the last light emitting. Apparently, before or after each light emitting in the second stage t2, reset should also be performed in first stages t1 that light is not emitted. In this embodiment, the reset process of the second reset device 1132 is arranged in the enabled stage of the first stage of the switch device 20, so that the time utilization rate is improved, the time interval is reduced, not only bias adjustment on the threshold voltage of the driving transistor is performed in a limited time period, but also light emitting processes in the holding stage is adapted to and to perform early reset of the light emitting diode. In addition, second stages t2 are provided and the frequency of light emitting in the holding stage can be increased, and avoiding the phenomenon that the display panel is easy to flicker due to the low-frequency light emitting.

Based on the principle and method of performing the threshold voltage bias compensation by using the switch device in the above embodiments, the embodiments of the present disclosure further provide implementation modes of the switch device and the implementation modes are described one by one below.

Figure 9:
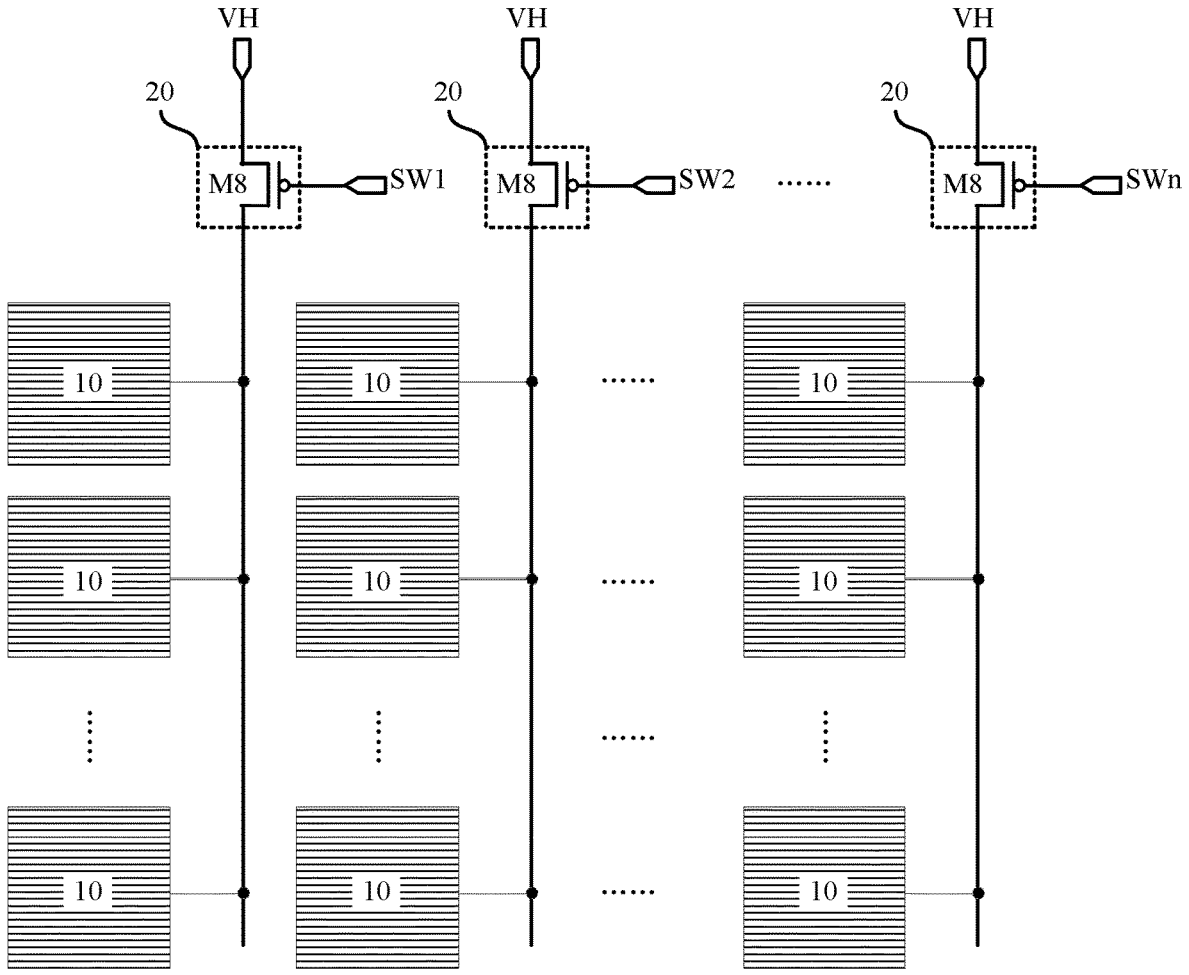
FIG. 9 is a circuit structure diagram of another display panel according to an embodiment of the present disclosure.

In the display panel shown in FIG. 4, each sub-pixel is correspondingly provided with a switch device 20, and the threshold voltages of the driving transistors in the sub-pixels are adjusted by the switch devices 20 in one-to-one correspondence. Considering that an area of the pixel driving circuit will apparently affect the pixel aperture opening ratio of the display panel, embodiments of the present disclosure provide another circuit structure. FIG. 9 is a circuit structure diagram of another display panel according to an embodiment of the present disclosure. Referring to FIG. 4 and FIG. 9, on the basis of the above embodiments the display panel is provided with sub-pixels 10, the plurality of sub-pixels 10 are arranged in an array, and first terminals of driving devices 111 of sub-pixels 10 of the same column are all connected to a first terminal of the same switch device 20.

In this case, threshold voltage bias compensation of the driving transistors of the plurality of sub-pixels 10 of the same column is performed simultaneously by the same switch device 20. In this way, not only can the time for the entire display panel to perform threshold voltage bias compensation on all sub-pixels 10 be reduced, but also can the number of switch devices 20 in the display panel be greatly saved and the arrangement of gating signal lines and biased compensation voltage lines is reduced, and improving the area utilization rate of the display panel, and reducing the influence on the aperture opening ratio of the display panel to a certain extent.

Figure 10:
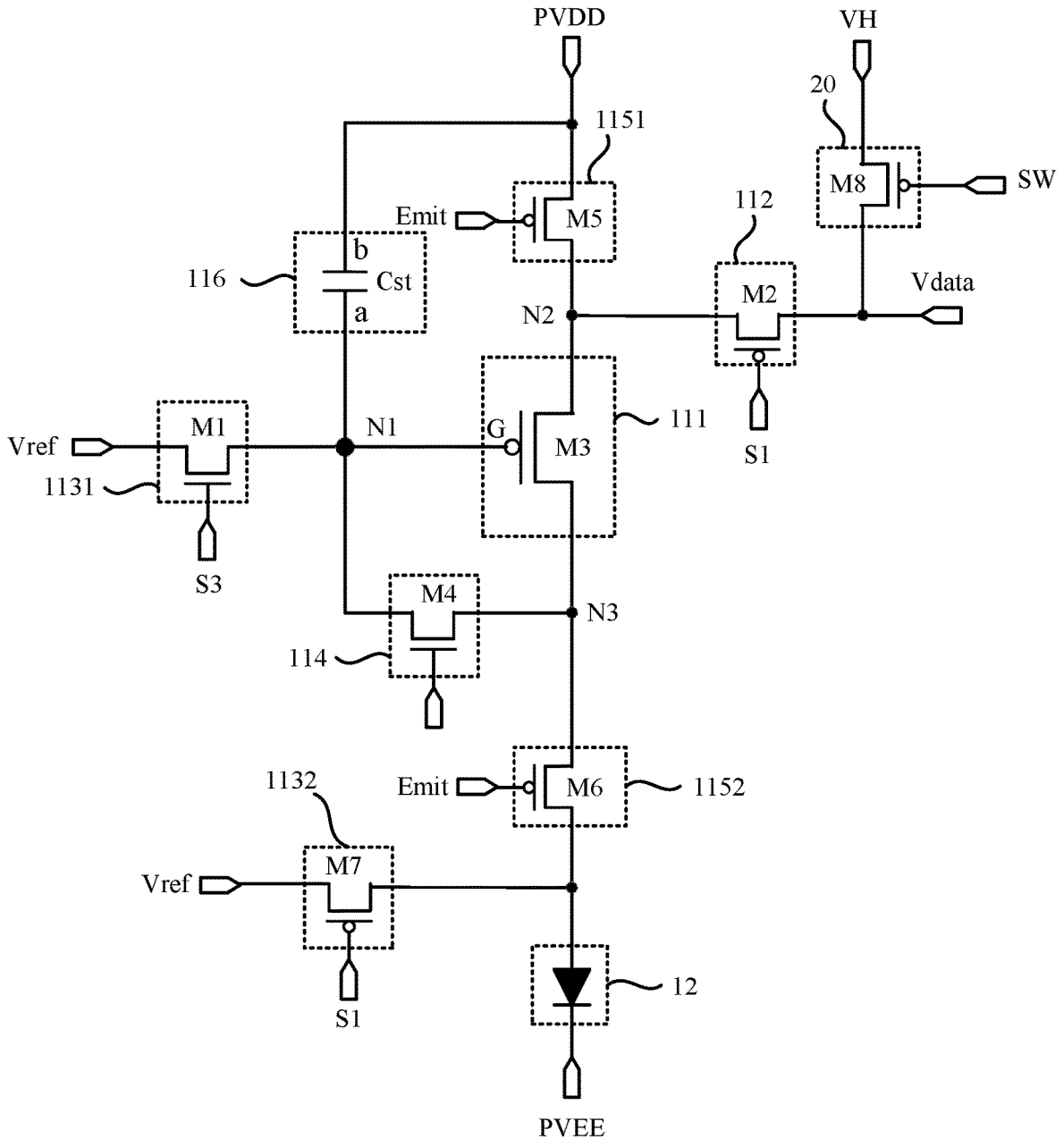
FIG. 10 is a circuit structure diagram of a sub-pixel and a switch device of another display panel according to an embodiment of the present disclosure.
Figure 11:
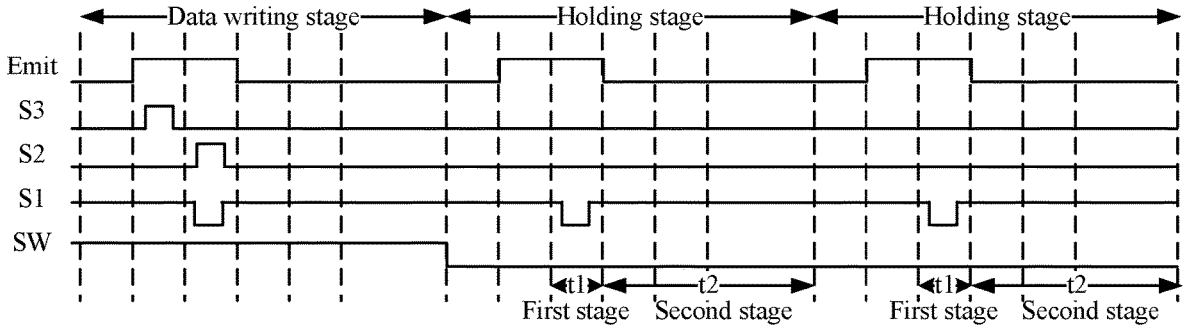
FIG. 11 is a driving timing diagram of the sub-pixel of the display panel shown in FIG. 10.

In addition, as shown in FIG. 4, the first terminal of the switch device 20 is connected to the first terminal of the driving device 111 and the first terminal of the data writing device 112, and the second terminal of the switch device 20 is connected to the biased compensation voltage terminal Vth. In this case, the switch device 20 and the data writing device 112 can respectively and independently provide the biased compensation voltage Vth or the data voltage Vdata to the driving device 111 without interfering with each other. Corresponding to this embodiment, the present disclosure also provides another embodiment. FIG. 10 is a circuit structure diagram of a sub-pixel and a switch device of another display panel according to an embodiment of the present disclosure. FIG. 11 is a driving timing diagram of the sub-pixel of the display panel shown in FIG. 10. Referring to FIG. 10 and FIG. 11 a first terminal of the driving device 111 is electrically connected to a first terminal of the data writing device 112, a second terminal of the driving device 111 is electrically connected to an anode of the light emitting element 12, a second terminal of the data writing device 112 is electrically connected to the first terminal of the switch device 20, and the second terminal of the switch device 20 is connected to the biased compensation voltage terminal Vth. The data writing device 112 is configured to transmit the biased compensation voltage provided by the switch device 20 to the first terminal of the driving device 111 in the first stage.

In this embodiment, the biased compensation voltage Vth provided by the biased compensation voltage terminal needs to be controlled by the switch device 20 and the data writing device 112. When the bias compensation of the threshold voltage of the driving transistor is performed in the first stage, the switch device 20 and the data writing device 112 need to be turned on synchronously. The biased compensation voltage Vth may be directly controlled by the data writing device 112 in the data writing process.

It is to be noted that in this embodiment, the control terminal of the second reset device 1132 and the control terminal of the data writing device 112 may be configured to connect the same control signal, that is, the first scanning signal S1. On this basis, in this embodiment, the switch device 20 may be configured to provide a biased compensation voltage VH to the first terminal of the driving device 111 in each first stage t1. In each first stage t1, an enabled stage of the second reset device 1132 is located within an enabled stage of the switch device 20.

Referring to FIG. 11, it is to be understood that both the data writing device 112 and the second reset device 1132 are turned on in the enabled stage of the first scan signal S1, and at this time, the reset signal terminal Vref provides a reset signal to the anode of the light emitting element 12. At the same time, in the first stage t1, a gating signal SW is enabled, and the switch device 20 provides the threshold compensation voltage VH through the turned-on data writing device 112.

Figure 12:
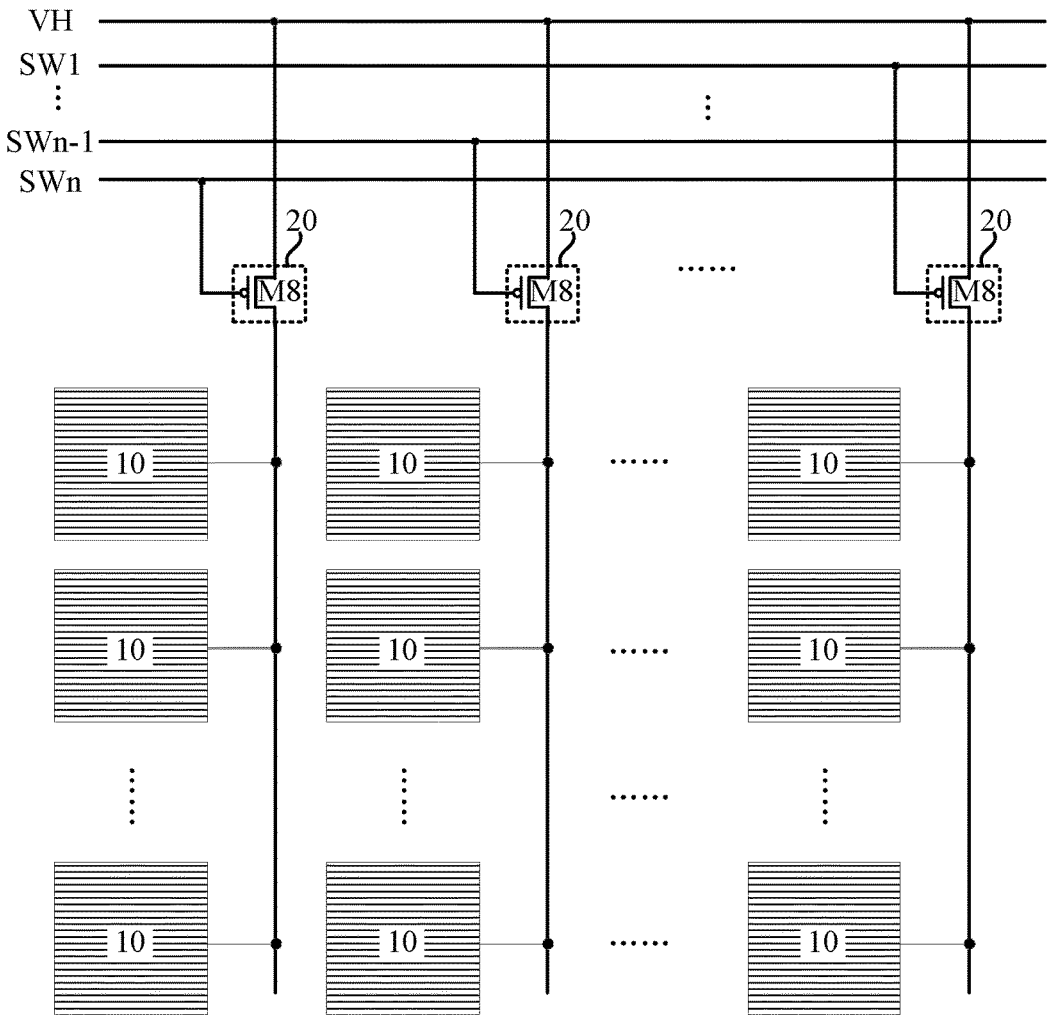
FIG. 12 is a schematic diagram illustrating arrangement of sub-pixels of a display panel according to an embodiment of the present disclosure.
Figure 13:
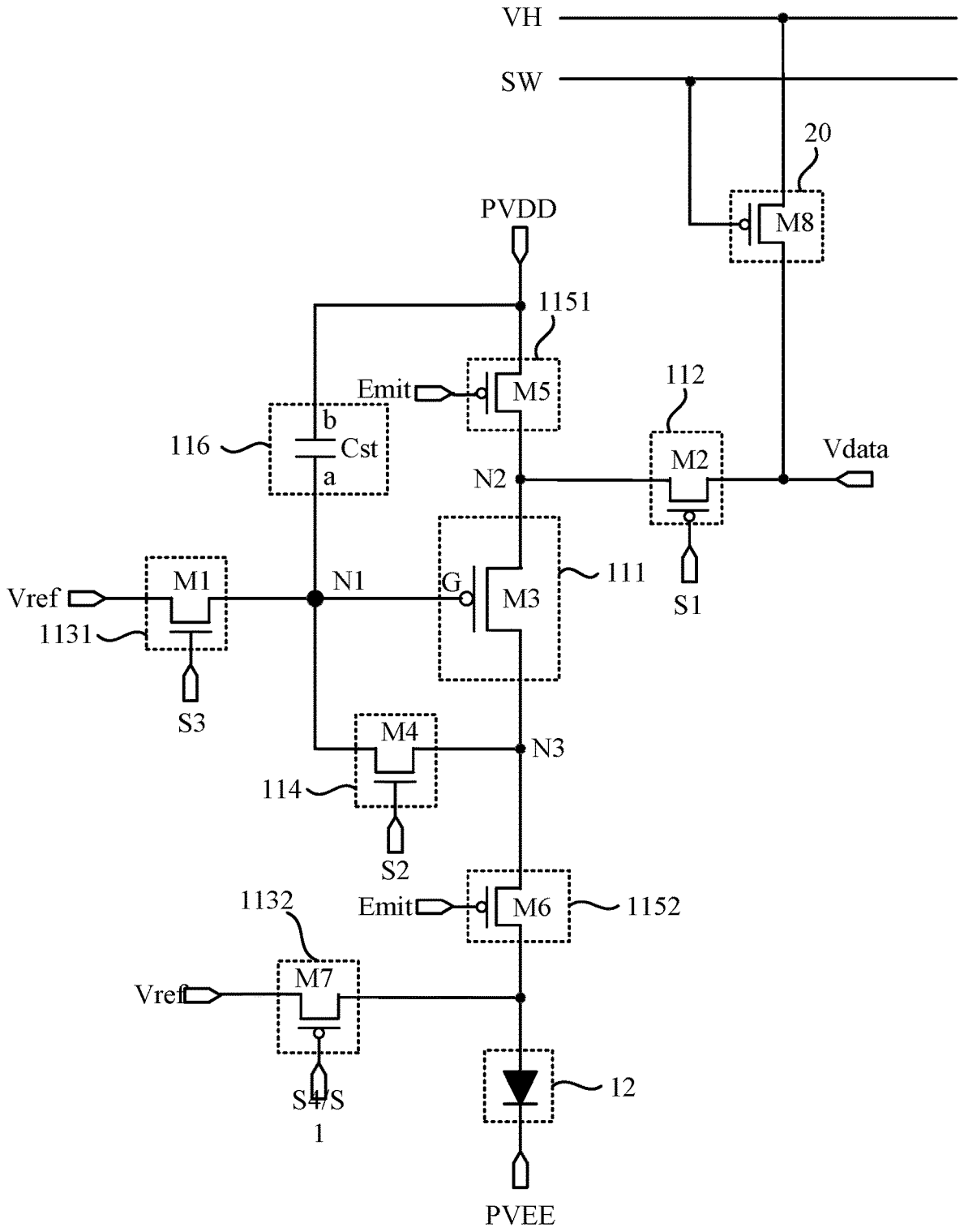
FIG. 13 is a circuit structure diagram of the sub-pixel shown in FIG. 12 and a switch device in the display panel.

FIG. 12 is a schematic diagram illustrating arrangement of sub-pixels of a display panel according to an embodiment of the present disclosure. FIG. 13 is a circuit structure diagram of the sub-pixel and a switch device in the display panel shown in FIG. 12. Referring to FIG. 12 and FIG. 13 sub-pixels 10 are provided, the plurality of sub-pixels 10 are arranged in an array, and all second terminals of data writing devices 112 of sub-pixels 10 of the same column are connected to a first terminal of the same switch device 20.

Similarly to the display panel shown in FIG. 9, data writing devices 112 of sub-pixels 10 of the same column are connected to the same switch device 20, and the number of switch devices 20 in the display panel can be greatly reduced, and the arrangement of gating signal lines and biased compensation voltage lines can be reduced. Moreover, on the basis that the biased compensation voltage is provided by the same switch device 20, the actual time of threshold voltage bias compensation may be controlled by a data writing device 112 corresponding to a sub-pixel 10 for each sub-pixel 10 in the same column, and to reasonably adjust a time position of threshold voltage bias compensation for each sub-pixel 10.

Figure 14:
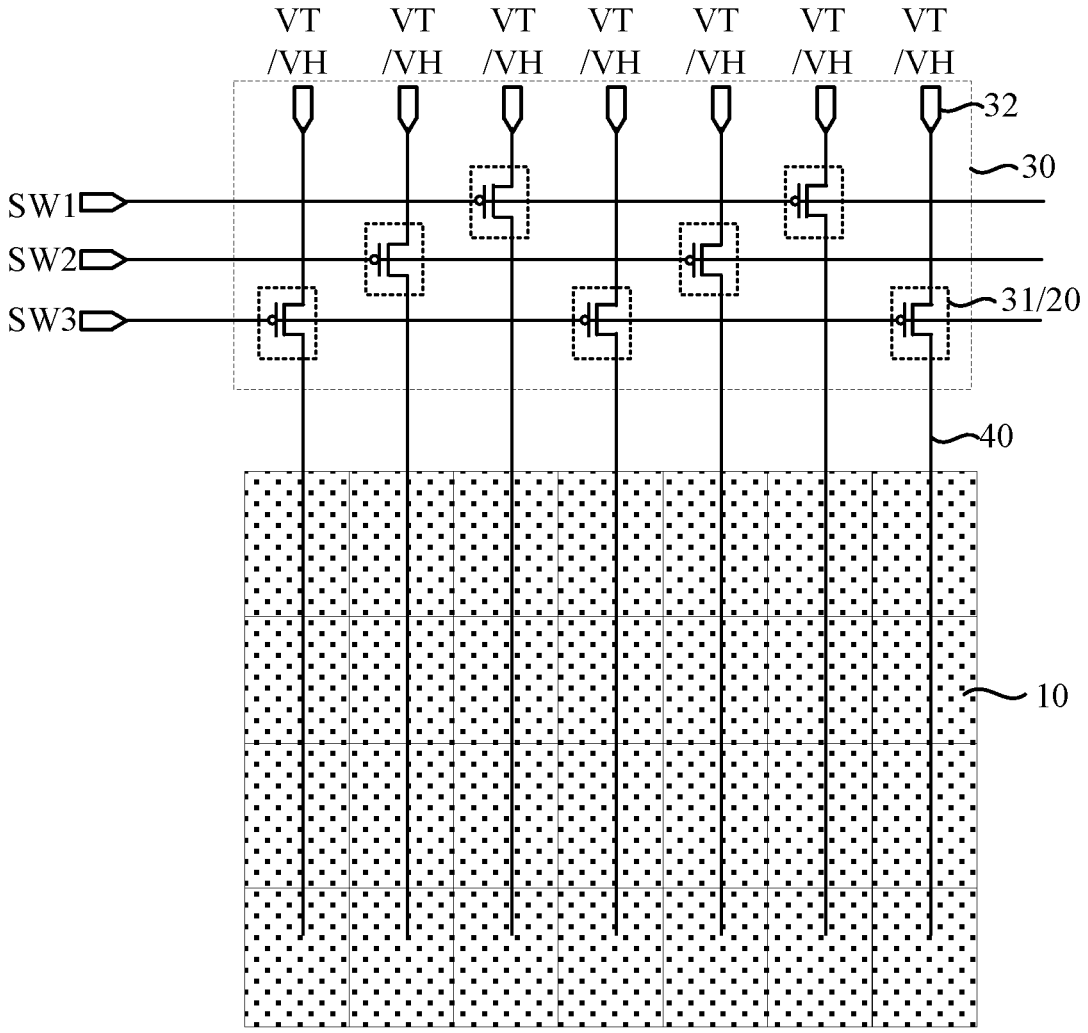
FIG. 14 is a circuit structure diagram of another display panel according to an embodiment of the present disclosure.

FIG. 14 is a circuit structure diagram of a sub-pixel and a switch device of another display panel according to an embodiment of the present disclosure. Referring to FIG. 4 and FIG. 14 the display panel further includes a visual test circuit 30 and data lines 40 extending along a column direction. The second terminals of the data writing devices 112 of sub-pixels 10 of the same column are connected to the same data line 40. The visual test circuit 30 includes gating devices 31 and visual test terminals 32, and the plurality of gating devices 31 are in one-to-one correspondence with the plurality of data lines 40. The plurality of gating devices 31 are also used as switch devices 20, and the plurality of visual test terminals 32 are also used as biased compensation voltage terminals VH. The gating device 31 is configured to transmit a visual test signal transmitted by the visual test terminal 32 to the data lines 40 in a display test stage, and to transmit the visual test signal to the second terminal of the data writing device 112 through the data line 40. The gating device 31 is configured to transmit a biased compensation voltage transmitted by the visual test terminal 32 to the data line 40 in the first stage, and to transmit the biased compensation voltage VH to the second terminal of the data writing device 112 through the data line 40.

In this embodiment, the visual test circuit 30 is configured to perform a visual test on the display panel in a test stage of the display panel before the display panel leaves the factory and to detect abnormal conditions of sub-pixels. It is to be understood that on the basis of the inherent visual test circuit 30 of the display panel, the visual test circuit is also used as the switch device and the biased compensation voltage terminal in this embodiment, and reducing the number of switch devices and the number of pads, improving the utilization rate of the display panel, facilitating the reduction of the arrangement density of lines and components, and reducing the arrangement design difficulty of signal traces and gating devices.

Figure 15:
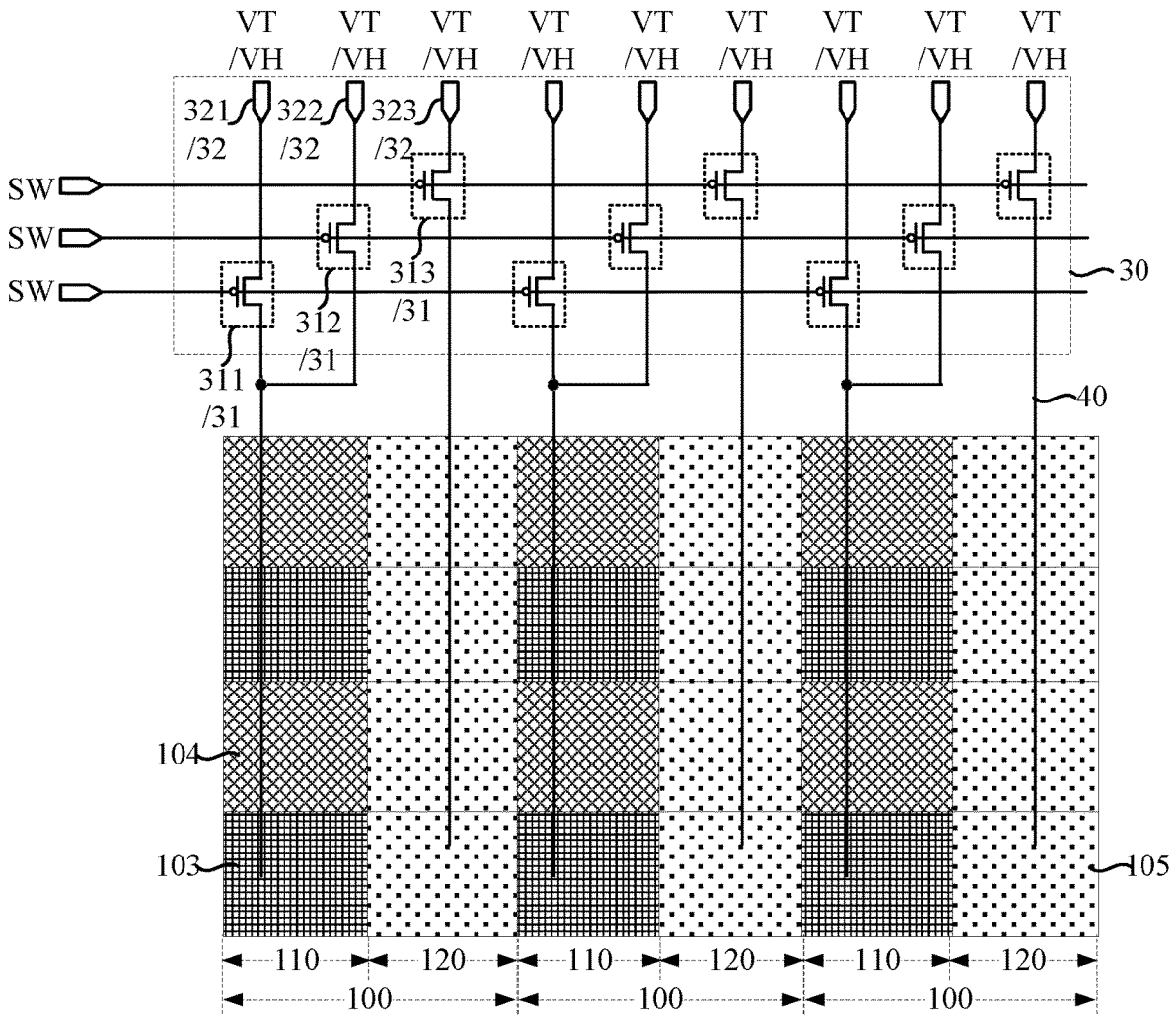
FIG. 15 is a circuit structure diagram of another display panel according to an embodiment of the present disclosure.

FIG. 15 is a circuit structure diagram of another display panel according to an embodiment of the present disclosure. Referring to FIG. 4 and FIG. 15, on the basis of the above embodiments, the display panel may be provided with pixel column groups 100. Each pixel column group includes a first pixel column 110 and a second pixel column 120. The first pixel column 110 includes third color sub-pixels 103 and fourth color sub-pixels 104, the third color sub-pixels 103 and the fourth color sub-pixels 104 are sequentially arranged at intervals along the column direction; and sub-pixels in the second pixel column 120 each are fifth color sub-pixels 105. The plurality of visual test terminals 32 include a first visual test terminal 321, a second visual test terminal 322 and a third visual test terminal 323. A gating device 31 corresponding to the first pixel column 110 includes a first gating unit 311 and a second gating unit 312, and a gating device 31 corresponding to the second pixel column 120 includes a third gating unit 313.

A first terminal of the first gating unit 311 is electrically connected to a data line 40 corresponding to the first pixel column 110, and a second terminal of the first gating unit 311 is electrically connected to the first visual test terminal 321. The first gating unit 311 is configured to transmit a first screen touch signal transmitted by the first visual test terminal 321 to the data line 40 in the display test stage, and to transmit the first screen touch signal to a second terminal of a data writing device 112 in each third color sub-pixel 103 in the first pixel column 110 through the data line 40. The first gating unit 311 is further configured to transmit a biased compensation voltage transmitted by the first screen test touch terminal 3321 to the data line 40 in the first stage, and to transmit the biased compensation voltage to a second terminal of a data writing device 112 of each sub-pixel 10 in the first pixel column 110 through the data line 40. A first terminal of the second gating unit 312 is electrically connected to the data line corresponding to the first pixel column 110, and a second terminal of the second gating unit 312 is electrically connected to the second visual test terminal 322. The second gating unit 312 is configured to transmit a second screen touch signal transmitted by the second visual test terminal 322 to the data line 40 in the display test stage, and to transmit the second screen touch signal to a second terminal of a data writing device 112 in each fourth color sub-pixel 104 in the first pixel column 110 through the data line 40. A first terminal of the third gating unit 313 is electrically connected to a data line 40 corresponding to the second pixel column 120, and a second terminal of the third gating unit 313 is electrically connected to the third visual test terminal 323. The third gating unit 313 is configured to transmit a third screen touch signal transmitted by the third visual test terminal 323 to the data line 40 in the display test stage, and to transmit the third screen touch signal to a second terminal of a data writing device 112 of each fifth color sub-pixel 105 in the second pixel column 120 through the data line 40. The third gating unit 313 is further configured to transmit a biased compensation voltage transmitted by the third screen test touch terminal 323 to a second terminal of a data writing device 112 of each sub-pixel 10 in the second pixel column 120.

The third color sub-pixels 103, the fourth color sub-pixels 104 and the fifth color sub-pixels 105 are red sub-pixels, blue sub-pixels and green sub-pixels, respectively. The arrangement mode of sub-pixels in the display panel is not a simple arrangement in which a red sub-pixel, a green sub-pixel and a blue sub-pixel are alternate sequentially, while, the red sub-pixels and the blue sub-pixels are arranged in one column, two adjacent red sub-pixel and blue sub-pixel in the column direction can be shared with a green sub-pixel adjacent in the row direction, and increasing the density of pixel units and improving the resolution of the display panel. On the basis of the arrangement mode of sub-pixels of the display panel, in this embodiment, the third color sub-pixels and the fourth color sub-pixels arranged in the same column are provided with a VT test signal or a biased compensation voltage VH through the same data line and the same gating unit, so that the number of gating units in the display panel can be saved, and the area utilization rate of the display panel can be increased.

Embodiments of the present disclosure further provide a display device, and the display device may include the display panel of any embodiment of the present disclosure. Moreover, since the display device is made of the above-mentioned display panel, the display device has the same or corresponding effects as the above-mentioned display panel. In an embodiment, the display device may be a mobile phone, a tablet, a computer, a television, a wearable smart device, and the like, and is not limited in the embodiments of the present disclosure.

What is claimed is:

1. A display panel, comprising:

a substrate;

a sub-pixel disposed on one side of the substrate; wherein the sub-pixel comprises a pixel driving circuit and a light emitting element, and the pixel driving circuit comprises a driving device and a data writing device; and a switch device, wherein a first terminal of the switch device is electrically connected to a first terminal of the driving device, and a second terminal of the switch device is connected to a biased compensation voltage terminal; wherein the biased compensation voltage terminal is configured to transmit a biased compensation voltage;

wherein the display panel further comprises a plurality of image update periods, each of the plurality of image update periods comprises a data writing stage and a holding stage, and the holding stage comprises a first stage and a second stage;

wherein in the data writing stage, the data writing device is turned on, the switch device is turned off and the driving device is configured to generate a driving current according to a data voltage transmitted by the data writing device;

wherein in the first stage, the switch device is turned off, and the switch device is configured to provide the biased compensation voltage to the first terminal of the driving device in the first stage; and wherein in the second stage, the data writing device is turned off, the switch device is turned off, and the driving device is configured to continue to provide the driving current to the light emitting element.

2. The display panel of claim 1, wherein target brightness corresponding to the sub-pixel in an i-th image update period is first brightness, and target brightness corresponding to the sub-pixel in an i+1-th image update period is second brightness, a first brightness is less than a second brightness; wherein i is a natural number greater than or equal to 1, and the i+1-th image update period is an image update period after the i-th image update period; and the switch device is configured to provide a first biased compensation voltage to the first terminal of the driving device in a first stage of the i-th image update period, wherein $V_1 \geq V_{pvdd}+V_B-V_W$, $V_1$ is the first biased compensation voltage, $V_{pvdd}$ is a voltage of the first terminal of the driving device in a second stage of the i-th image update period, $V_B$ is a data voltage transmitted by the data writing device in a data writing stage of the i-th image update period, and $V_W$ is a data voltage transmitted by the data writing device in a data writing stage of the i+1-th image update period.

3. The display panel of claim 1, wherein target brightness corresponding to the sub-pixel in an i-th image update period is first brightness, and target brightness corresponding to the sub-pixel in an i+1-th image update period is second brightness, and a first brightness is greater than a second brightness; wherein i is a natural number greater than or equal to 1, and the i+1-th image update period is an image update period after the i-th image update period; and the switch device is configured to provide a first biased compensation voltage to the first terminal of the driving device in a first stage of the i-th image update period, wherein $V_2 \leq V_{pvdd}+V_W-V_B$, $V_2$ is the first biased compensation voltage, $V_{pvdd}$ is a potential of the first terminal of the driving device in a second stage of the i-th image update period, $V_W$ is a data voltage transmitted by the data writing device in a data writing stage of the i-th image update period; and $V_B$ is a data voltage transmitted by the data writing device in a data writing stage of the i+1-th image update period.

4. The display panel of claim 1, wherein the holding stage comprises first stages and second stages, the first stages and the second stages are arranged periodically at intervals; and the switch device is configured to provide the biased compensation voltage to the first terminal of the driving device in each of the first stages.

5. The display panel of claim 4, wherein a plurality of sub-pixels of the display panel are provided, the plurality of sub-pixels are arranged in an array, and first terminals of driving devices of sub-pixels of a same column are all connected to a first terminal of a same switch device.

6. The display panel of claim 1, wherein a plurality of sub-pixels of the display panel comprise:

a first color sub-pixel and a second color sub-pixel, a data voltage transmitted by a data writing device in the first color sub-pixel is a first data voltage (Vdata1), and a data voltage transmitted by a data writing device in the second color sub-pixel is a second data voltage (Vdata2), wherein (Vdata1)<(Vdata2); and the display panel further comprises a plurality of switch devices and a plurality of biased compensation voltage terminals, and the plurality of switch devices are in one-to-one correspondence with the plurality of biased compensation voltage terminals; and the plurality of switch devices comprise a first switch device and a second switch device, a biased compensation voltage terminal electrically connected to a second terminal of the first switch device is a first biased compensation voltage terminal, a biased compensation voltage terminal electrically connected to a second terminal of the second switch device is a second biased compensation voltage terminal, the first biased compensation voltage terminal is configured to transmit a first biased compensation voltage (V3), and the second biased compensation voltage terminal is configured to transmit a second biased compensation voltage (V4), wherein (V3)>(V4).

7. The display panel of claim 1, wherein the pixel driving circuit further comprises a first reset device, a threshold compensation device, a first light emitting control device, a storage device, a second reset device and a second light emitting control device; wherein the threshold compensation device is configured to compensate a threshold voltage of the driving device;

the first light emitting control device is configured to provide a first power supply signal to the first terminal of the driving device;

the second light emitting control device is configured to control the driving current generated by the driving device to be transmitted to the light emitting element; the first reset device is configured to provide a first reset signal to a control terminal of the driving device;

the second reset device is configured to provide a second reset signal to an anode of the light emitting element;

a control terminal of the data writing device is electrically connected to a first scanning signal terminal, a first terminal of the data writing device is electrically connected to the first terminal of the driving device, and a second terminal of the data writing device is electrically connected to a data signal terminal;

a control terminal of the threshold compensation device is electrically connected to a second scanning signal terminal, a first terminal of the threshold compensation device is electrically connected to a second terminal of the driving device, and a second terminal of the threshold compensation device is electrically connected to the control terminal of the driving device;

a control terminal of the first light emitting control device is electrically connected to a light emitting control signal terminal, a first terminal of the first light emitting control device is electrically connected to a first power supply signal terminal, and a second terminal of the first light emitting control device is electrically connected to the first terminal of the driving device; and a control terminal of the second light emitting control device is electrically connected to the light emitting control signal terminal, a first terminal of the second light emitting control device is electrically connected to the second terminal of the driving device, and a second terminal of the second light emitting control device is electrically connected to the anode of the light emitting element;

a cathode of the light emitting element is electrically connected to a second power supply signal terminal;

a control terminal of the first reset device is electrically connected to a third scanning signal terminal, a first terminal of the first reset device is electrically connected to a reset signal terminal, and a second terminal of the first reset device is electrically connected to the control terminal of the driving device; and a control terminal of the second reset device is electrically connected to a fourth scanning signal terminal, a first terminal of the second reset device is electrically connected to the reset signal terminal, and a second terminal of the second reset device is electrically connected to the anode of the light emitting element.

8. The display panel of claim 7, wherein the first scanning signal terminal and the second scanning signal terminal are configured to receive a same control signal.

9. The display panel of claim 7, wherein the threshold compensation device and the first reset device each comprise an oxide transistor.

10. The display panel of claim 7, wherein an enabled stage of data writing device does not overlap with an enabled stage of the first light emitting control device and an enabled stage of the second light emitting control device.

11. The display panel of claim 7, wherein the holding stage comprises:

first stages and second stages, the first stages and the second stages are arranged periodically at intervals;

the switch device is configured to provide the biased compensation voltage to the first terminal of the driving device in each of the first stages; and an enabled stage of the second reset device in the each of the first stages is within an enabled stage of the switch device in the each of the first stages.

12. The display panel of claim 1, wherein the switch device, the driving device and the data writing device each comprise a thin film transistor.

13. The display panel of claim 1, wherein the first terminal of the driving device is electrically connected to a first terminal of the data writing device, a second terminal of the driving device is electrically connected to an anode of the light emitting element, a second terminal of the data writing device is electrically connected to the first terminal of the switch device, and the second terminal of the switch device is connected to the biased compensation voltage terminal; and the data writing device is configured to transmit the biased compensation voltage provided by the switch device to the first terminal of the driving device in the first stage.

14. The display panel of claim 13, wherein a plurality of sub-pixels of the display panel are provided, the plurality of sub-pixels are arranged in an array, and second terminals of data writing devices of sub-pixels of a same column are all connected to a first terminal of a same switch device.

15. The display panel of claim 14, further comprising: a visual test circuit and a plurality of data lines extending along a column direction, wherein second terminals of data writing devices of the sub-pixels of the same column are connected to a same data line;

the visual test circuit comprises a plurality of gating devices and a plurality of visual test terminals, and the plurality of gating devices are in one-to-one correspondence with the plurality of data lines;

the plurality of gating devices are also used as a plurality of switch devices, and the plurality of visual test terminals are also used as a plurality of biased compensation voltage terminals;

the plurality of gating devices are configured to transmit a plurality of visual test signals transmitted by the plurality of visual test terminals to the plurality of data lines in a display test stage, and to transmit the plurality of visual test signals to the second terminals of the data writing devices through the plurality of data lines; and the plurality of gating devices are configured to transmit a plurality of biased compensation voltages transmitted by the plurality of visual test terminals to the plurality of data lines in the first stage, and to transmit the plurality of biased compensation voltages to the second terminals of the data writing devices through the plurality of data lines.

16. The display panel of claim 15, comprising:

a plurality of pixel column groups, wherein each of the plurality of pixel column groups comprises a first pixel column and a second pixel column, the first pixel column comprises first color sub-pixels and second color sub-pixels, the first color sub-pixels and the second color sub-pixels are sequentially arranged at intervals along the column direction, and sub-pixels in the second pixel column are third color sub-pixels;

the plurality of visual test terminals comprise a first visual test terminal, a second visual test terminal and a third visual test terminal;

a gating device corresponding to the first pixel column comprises a first gating unit and a second gating unit, and a gating device corresponding to the second pixel column comprises a third gating unit;

a first terminal of the first gating unit is electrically connected to a data line corresponding to the first pixel column, and a second terminal of the first gating unit is electrically connected to the first visual test terminal; the first gating unit is configured to transmit a first screen touch signal transmitted by the first visual test terminal to the data line corresponding to the first pixel column in the display test stage, and to transmit the first screen touch signal to a second terminal of a data writing device of each first color sub-pixel in the first pixel column through the data line corresponding to the first pixel column; and the first gating unit is further configured to transmit a biased compensation voltage transmitted by the first visual test terminal to the data line corresponding to the first pixel column in the first stage, and to transmit the biased compensation voltage to a second terminal of a data writing device of each sub-pixel in the first pixel column through the data line corresponding to the first pixel column;

a first terminal of the second gating unit is electrically connected to the data line corresponding to the first pixel column, and a second terminal of the second gating unit is electrically connected to the second visual test terminal; the second gating unit is configured to transmit a second screen touch signal transmitted by the second visual test terminal to the data line corresponding to the first pixel column in the display test stage, and to transmit the second screen touch signal to a second terminal of a data writing device of each second color sub-pixel in the first pixel column through the data line corresponding to the first pixel column; and a first terminal of the third gating unit is electrically connected to a data line corresponding to the second pixel column, and a second terminal of the third gating unit is electrically connected to the third visual test terminal; the third gating unit is configured to transmit a third screen touch signal transmitted by the third visual test terminal to the data line corresponding to the second pixel column in the display test stage, and to transmit the third screen touch signal to a second terminal of a data writing device of each third color sub-pixel in the second pixel column through the data line corresponding to the second pixel column; and the third gating unit is further configured to transmit a biased compensation voltage transmitted by the third visual test terminal to a second terminal of a data writing device of each sub-pixel in the second pixel column.

17. A driving method for a display panel, which is applied to the display panel comprising:

a substrate;

a sub-pixel disposed on one side of the substrate; wherein the sub-pixel comprises a pixel driving circuit and a light emitting element, and the pixel driving circuit comprises a driving device and a data writing device; and a switch device, wherein a first terminal of the switch device is electrically connected to a first terminal of the driving device, and a second terminal of the switch device is connected to a biased compensation voltage terminal;

wherein the biased compensation voltage terminal is configured to transmit a biased compensation voltage;

wherein the display panel further comprises a plurality of image update periods, each of the plurality of image update periods comprises a data writing stage and a holding stage, and the holding stage comprises a first stage and a second stage;

wherein the driving device is configured to generate a driving current according to a data voltage transmitted by the data writing device in the data writing stage; and the driving device is further configured to provide the driving current to the light emitting element in the second stage; and wherein the switch device is configured to provide the biased compensation voltage to the first terminal of the driving device in the first stage, and the driving method comprising:

S1, in the data writing stage, turning on the data writing device, turning off the switch device, and the driving device providing the driving current to the light emitting element according to a data signal transmitted by the data writing device;

S2, in the first stage, turning off the switch device, and the switch device providing the biased compensation voltage to the first terminal of the driving device; and S3, in the second stage, turning off the data writing device, turning off the switch device, and the driving device continuing to provide the driving current to the light emitting element.

18. The driving method for the display panel of claim 17, further comprising:

determining a driving mode of the display panel;

and further comprising:

S4, in the data writing stage, turning on the data writing device, turning off the switch device, and the driving device providing the driving current to the light emitting element according to the data voltage transmitted by the data writing device; and in the holding stage, turning off the data writing device and turning off the switch device, wherein in response to the driving mode being a low-frequency driving mode, S1, S2, and S3 are executed; and in response to the driving mode being a high-frequency driving mode, S4 is executed.

19. The driving method for the display panel of claim 18, wherein determining the driving mode of the display panel comprises:

in response to an image update period frequency of the display panel being less than or equal to 15 Hz, determining the driving mode as the low-frequency driving mode; otherwise, determining the driving mode as the high-frequency driving mode.

20. The driving method for the display panel of claim 17, wherein target brightness corresponding to the sub-pixel in an i-th image update period is first brightness, and target brightness corresponding to the sub-pixel in an i+1-th image update period is second brightness, wherein i is a natural number greater than or equal to 1, and the i+1-th image update period is an image update period after the i-th image update period; and the driving method for the display panel further comprises:

determining whether a first brightness is less than a second brightness;

in response to the first brightness being less than the second brightness, the switch device providing a first biased compensation voltage to the first terminal of the driving device in a first stage of the i-th image update period, wherein $V_1 \geq V_{pvdd}+V_B-V_W$, $V_1$ is the first biased compensation voltage, $V_{pvdd}$ is a voltage of the first terminal of the driving device in a second stage of the i-th image update period, $V_B$ is a data voltage transmitted by the data writing device in a data writing stage of the i-th image update period, and $V_W$ is a data voltage transmitted by the data writing device in a data writing stage of the i+1-th image update period.

21. The driving method for the display panel of claim 17, wherein target brightness corresponding to the sub-pixel in an i-th image update period is first brightness, and target brightness corresponding to the sub-pixel in an i+1-th image update period is second brightness, wherein i is a natural number greater than or equal to 1, and the i+1-th image update period is the image update period after the i-th image update period; and the driving method for the display panel further comprises:

determining whether the first brightness is greater than the second brightness; and in response to the first brightness being greater than the second brightness, the switch device providing a first biased compensation voltage to the first terminal of the driving device in a first stage of the i-th image update period, wherein $V_2 \leq V_{pvdd}+V_W-V_B$, $V_2$ is the second first biased compensation voltage, $V_{pvdd}$ is a potential of the first terminal of the driving device in a second stage of the i-th image update period, $V_W$ is a data voltage transmitted by the data writing device in a data writing stage of the i-th image update period; and $V_B$ is a data voltage transmitted by the data writing device in a data writing stage of the i+1-th image update period.

* * * * *